US008220293B2

(12) United States Patent
Deppermann et al.

(10) Patent No.: US 8,220,293 B2
(45) Date of Patent: Jul. 17, 2012

(54) TREATING AGENT DISPENSING SYSTEM FOR A WASHING MACHINE, AND WASHING MACHINE

(75) Inventors: Thomas Deppermann, Guetersloh (DE); Michael Finke, Hoevelhof (DE); Olaf Witte, Detmold (DE)

(73) Assignee: Miele & Cie. KG, Guetersloh (DE)

( * ) Notice: Subject to any disclaimer, the term of this patent is extended or adjusted under 35 U.S.C. 154(b) by 859 days.

(21) Appl. No.: 12/243,618

(22) Filed: Oct. 1, 2008

(65) Prior Publication Data

US 2009/0090141 A1 Apr. 9, 2009

(30) Foreign Application Priority Data

Oct. 8, 2007 (DE) ..... 10 2007 048 197

(51) Int. Cl.
*D06F 39/02* (2006.01)

(52) U.S. Cl. ..... 68/17 R; 68/17 A; 221/123; 221/124; 221/200

(58) Field of Classification Search ..... None
See application file for complete search history.

(56) References Cited

U.S. PATENT DOCUMENTS

| | | | | |
|---|---|---|---|---|
| 3,982,666 | A * | 9/1976 | Kleimola et al. | 222/651 |
| 4,144,093 | A * | 3/1979 | Reinwald et al. | 134/13 |
| 4,895,274 | A | 1/1990 | Morimoto et al. | |
| 5,142,887 | A * | 9/1992 | Priem et al. | 68/18 FA |
| 5,829,085 | A | 11/1998 | Jerg et al. | |
| 6,826,933 | B2 * | 12/2004 | Merkle et al. | 68/17 R |
| 2005/0247742 | A1 * | 11/2005 | Livingston et al. | 222/444 |
| 2006/0107705 | A1 | 5/2006 | Hsu et al. | |
| 2007/0056330 | A1 * | 3/2007 | Song | 68/17 R |
| 2007/0084253 | A1 | 4/2007 | Ehrlich et al. | |
| 2007/0144558 | A1 | 6/2007 | Classen et al. | |
| 2008/0107576 | A1 * | 5/2008 | Zettlitzer et al. | 422/266 |
| 2009/0090139 | A1 | 4/2009 | Deppermann et al. | |
| 2009/0090140 | A1 | 4/2009 | Deppermann et al. | |

FOREIGN PATENT DOCUMENTS

| | | | |
|---|---|---|---|
| CA | 2204784 | | 5/1996 |
| DE | 3302893 | | 8/1984 |
| DE | 3433429 | A1 | 3/1986 |
| DE | 3533754 | A1 | 4/1987 |
| DE | 9303690 | | 6/1993 |
| DE | 4439680 | | 6/1996 |
| DE | 19652787 | A1 | 7/1998 |
| DE | 10234316 | | 2/2004 |
| DE | 102005050083 | | 4/2007 |
| EP | 0297371 | | 1/1989 |
| EP | 0520956 | A1 | 12/1992 |
| FR | 1303147 | A | 9/1962 |
| JP | 2001314692 | A | 11/2001 |
| JP | 2008017943 | A | 1/2008 |

(Continued)

*Primary Examiner* — Michael Kornakov
*Assistant Examiner* — Ryan Coleman
(74) *Attorney, Agent, or Firm* — Leydig, Voit & Mayer, Ltd.

(57) ABSTRACT

A treating agent dispensing system for a washing machine including a base unit and at least two supply containers removably and securably disposed on the base unit. The at least two supply containers are respectively configured to receive a treating agent. The treating agent is a powdered treating agent or a liquid treating agent. A delivery device is disposed in the base unit and is operable to deliver the treating agent to the washing machine through a hose.

20 Claims, 6 Drawing Sheets

FOREIGN PATENT DOCUMENTS

| | | | |
|---|---|---|---|
| WO | WO-0220893 | A1 | 3/2002 |
| WO | WO-03022121 | A1 | 3/2003 |
| WO | WO-03023120 | | 3/2003 |
| WO | WO 2005058126 | A1 | 6/2005 |
| WO | WO-2005114115 | A1 | 12/2005 |
| WO | WO 2006061041 | A1 | 6/2006 |
| WO | WO-2007027779 | | 3/2007 |
| WO | WO-2007146458 | A2 | 12/2007 |

* cited by examiner

TREATING AGENT DISPENSING SYSTEM FOR A WASHING MACHINE, AND WASHING MACHINE

CROSS REFERENCE TO RELATED APPLICATIONS

Priority is claimed to German patent application DE 10 2007 048 197.9, filed Oct. 8, 2007, which is hereby incorporated by reference herein.

FIELD

The present invention relates to a treating agent dispensing system for a washing machine, including at least two supply containers for respectively holding a treating agent, such as detergent or washing or rinse additives, and further including a delivery device adapted to deliver the treating agent through a connecting hose to the washing machine.

The present invention further relates to a washing machine including a suds container for receiving wash liquid, a controller, and further including a dispensing system which may be located remotely from the washing machine and which is connected to the washing machine via two hose lines and is in operative connection with the controller of the washing machine.

BACKGROUND

In washing machines for domestic use, the detergent is usually manually introduced into a chamber and flushed with water into the suds container after the wash cycle has started. The user must observe the dosage instructions for the particular detergent used, and take care to fill the correct amount into the chamber. To facilitate charging with detergent or other additives, such as fabric softeners, automatic dispensing systems in which a relatively large amount of detergent is stored in a supply container may be used. Once a wash cycle is started, the preset amount of detergent will then be added to the wash liquid, which eliminates the need for the user to ensure that the proper amount of detergent is filled in each time a wash cycle is carried out. Such dispensing systems are frequently used especially in industrial washing machines.

German document DE 33 02 893 C2 describes a washing machine having a dispensing system for liquid detergents, which is disposed separately from the washing machine. The dispensing system includes a separate housing in which are fixedly installed two supply containers for additives and which accommodates a control device and the metering pump. Water from the suds container is conveyed through hose connections to the dispensing system, where the additive is added to this water. The water/additive mixture is pumped into the washing machine through a second conduit in a region of the flush-in channel for fresh water supply. The dispensing system described therein is designed as a separate add-on unit, for which an additional, predetermined fixed place must be provided laterally adjacent to the washing machine. Connection of the dispensing system to the washing machine is via two hoses or pipes and a cable for power supply to the pump and for signal and/or data transmission. Space constraints make it difficult to access the containers for filling or cleaning.

Another dispensing system for liquid additives is described in DE 10 2005 050 083 A1. In that patent application, a supply container for liquid detergents is located outside the washing machine and connected thereto via a hose line. Disposed within the washing machine is the metering pump, which delivers the liquid or viscous detergent through a hose line to the lower region of the suds container. The metering pump is controlled by the washing machine controller which, based on the ON-time, determines the amount of detergent to be dispensed at any one time.

With these dispensing systems, the user can only use liquid or viscous detergents.

A dispensing system for powdered detergent is described in EP 0 297 371 B1 and WO 03/023120 A1. The washing powder is released from a supply container into a mixing chamber, from where it is delivered to the washing machine. An agitator having at least one rotating blade agitates the powder within the container, causing it to flow through an opening into the mixing chamber. Once the desired amount has been introduced into the mixing chamber, the mixing chamber is flushed with water, the outflowing detergent/water mixture being directed through a conduit to the washing machine. This dispensing system is not suitable for use with liquid detergent.

World patent application WO 2007/027779 A1 described a liquid additive dispensing system for a dishwasher. The liquid treating agent is dispensed or released into the treatment chamber by means of a pump. The dispensing system includes a base unit having a plurality of supply containers inserted therein. In order to dispense powdered treating agent, a different base unit is provided which has an additional water inlet, allowing the powder to be mixed with water and subsequently pumped to the dishwasher. This dispensing system has the disadvantage that it is only suitable for either liquid or powdered treating agent.

SUMMARY

In view of the above, an aspect of the present invention is to provide a dispensing system or a washing machine that it is suitable for multiple types of detergents or treating agents.

In an embodiment, the present invention provides a treating agent dispensing system for a washing machine including a base unit and at least two supply containers removably and securably disposed on the base unit. The at least two supply containers are respectively configured to receive a treating agent. The treating agent is a powdered treating agent or a liquid treating agent. A delivery device is disposed in the base unit and is operable to deliver the treating agent to the washing machine through a hose.

BRIEF DESCRIPTION OF THE DRAWINGS

An exemplary embodiment of the present invention will be described in more detail below and is shown schematically in the drawings, in which.

DETAILED DESCRIPTION

Figure 1:
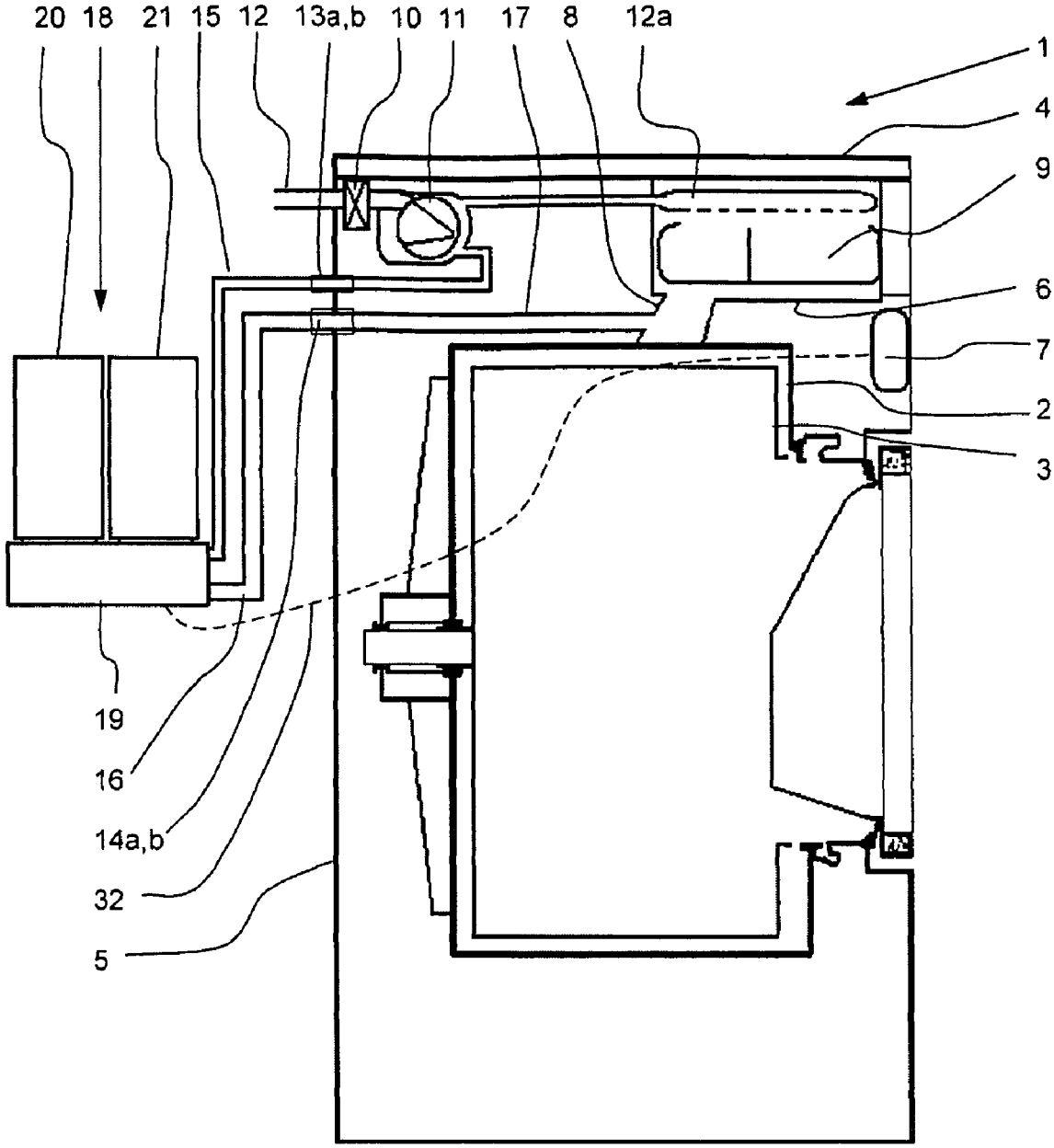
FIG. 1 is a schematic view showing the dispensing system connected to a washing machine.

The present invention provides increased convenience and improved reliability in terms of washing results. The user no longer needs to estimate the amount of detergent each time a wash cycle is carried out, or manually fill the detergent into a compartment of the dispensing drawer. The user may also continue to use his/her favorite type of detergent and that, for most of the laundry to be washed, the appropriate detergent is used in each particular case. Therefore, in an embodiment the dispensing system of the present invention is designed to allow for the use of both liquid treating agent, such as detergent for colored fabrics or fabric softener, and powdered detergent (powder, granules or pearls), so that it covers nearly all types of wash cycles in a domestic environment. To this end, the dispensing system includes a base unit on which the supply containers are removably placed and secured, the delivery device being disposed within the base unit and designed for use with both powdered and liquid treating agents.

In an embodiment, the delivery device includes a detergent solution pump and a mixing chamber for receiving the treating agent to be dispensed, it being possible for the treating agent that is released into the mixing chamber to be flushed out by inflowing water and be delivered to the washing machine by means of the detergent solution pump. This allows the dispensing system to be positioned as desired. It may even be positioned adjacent or below the washing machine because the detergent solution pump allows for the treating agent/water mixture to be introduced into the washing machine independently of gravity.

In an embodiment, the dispensing system includes at least one supply container for powdered treating agent, said supply container having an agitator which is coupled to and drivable by an electric motor, it being possible for the powdered treating agent to be released through an opening into the mixing chamber. The agitator makes the powder flowable, thereby causing it to pass through the opening into the mixing chamber, and thus allowing the predetermined amount to be metered with the highest accuracy possible.

In another embodiment, the dispensing system includes at least one supply container for liquid treating agent and a pump which is coupled to and drivable by an electric motor, the pump being capable of delivering the liquid treating agent into the mixing chamber. The pump may be a peristaltic pump and is used to deliver the predetermined amount from the container into the mixing chamber in a time-controlled manner, allowing for volumetric metering with very high accuracy.

In a suitable embodiment, the pump is secured to the supply container for liquid treating agent. In this manner, the pump is reliably associated with the corresponding container for liquid treating agent.

The pump and the agitator may be driven by a gear motor, respectively. In this case, a gear mechanism is coupled to the electric motor or formed as a unit therewith to provide a higher torque at the output of the gear mechanism. Thus, the motor can be of relatively low power and small size while still providing the torque required for breaking up lumps of powder or for pumping viscous additives.

In another embodiment, the gear motor for the agitator and the gear motor for the pump are disposed in the base unit. The motors are each provided with a coupling at the gear output to provide for detachable connection to the agitator or to the pump. This allows the containers to be easily removed from the base unit, for example for cleaning purposes.

Moreover, the containers, i.e. the type of container and treating agent to be used, may be selected freely. In an embodiment, the dispensing system includes two supply containers, it being possible to place and secure in the base unit one supply container for powdered treating agent and one supply container for liquid treating agent or, alternatively, two supply containers for powdered treating agent or, alternatively, two supply containers for liquid treating agent. Thus, the user is offered many possible combinations for the dispensing system.

Overall, it is beneficial to adapt the washing machine to the dispensing system in such a way that the controller of the washing machine is in communication with the dispensing system. Thus, depending on the wash cycle chosen, it is possible to select the container in the dispensing system that contains the right detergent, and to subsequently predetermine the amount to be dispensed.

The washing machine includes a connection which is controllable by an inlet valve and/or a water distributor and is connected to the dispensing system, and through which water can be delivered to the dispensing system, the washing machine further including an additional connection for the detergent solution that is deliverable from the dispensing system. The connection for the detergent solution is connected to the suds container via a flexible conduit, making it possible to compensate for the oscillatory movements of the suds container during operation.

In an embodiment, the washing machine has a detergent dispensing drawer disposed in the upper portion thereof, said detergent dispensing drawer being in communication via a water feed line for flushing detergents or additives out therefrom, the outlet of said detergent dispensing drawer being connected to the suds container via a flexible connecting tube, and the flexible conduit opening into said connecting tube. This allows the user to continue to use detergents or treating agents in a conventional way. For example, in special treatments in which the stored agents cannot be used, such as when washing curtains or functional textiles, a special detergent is introduced via the detergent dispensing drawer into the suds container for one wash cycle at any one time.

Generally, the washing machine has a housing including a rear wall which is provided with a connection for water supply to the solenoid valve and/or to the water distributor. In a suitable embodiment, the rear wall is also provided with the connection for the water to the dispensing system and the connection for the detergent solution that is deliverable from the dispensing system.

Referring to FIG. 1, the illustrated washing machine 1 includes a suds container 2 in which is rotatably mounted a drum 3 which is driven by an electric motor. Dispensing system 18 is located outside washing machine 1 and connected thereto via connecting hoses 15, 16. The additives used may be, for example, liquid detergents, washing additives or rinse additives, such as fabric softener. Dispensing system 18, which is separate from washing machine 1, may be placed and secured at different locations, as desired. Depending on the installation conditions of washing machine 1, the dispensing system may be placed or secured, for example, on housing 4 of washing machine 1, laterally adjacent thereto, or behind it. Washing machine 1 further includes a dispensing drawer 6 which may include a detergent compartment 9 for receiving the detergent for a wash cycle and which is connected to suds container 2 via a flexible tube 8. Dispensing drawer 6 is in communication with a water feed line 12, with a solenoid valve 10 and/or a water distributor 11 interposed therebetween, which is controllable by a controller 7, said dispensing drawer allowing detergent for a single wash cycle to be flushed into suds container 2 when dispensing system 18 is not used.

In order for detergent to be added from external dispensing system 18, water is supplied thereto via supply hose 15. The detergent/water mixture, i.e. the concentrated detergent solution, is delivered to washing machine 1 through detergent solution conduit 16; the rear wall 5 of washing machine 1 being provided with a connection 13*a* for coupling member 13*b* of water conduit 15 and with a connection 14*a* for coupling member 14*b* of detergent solution conduit 16. The detergent solution conduit 17 extending within the washing machine opens into flexible tube 8 on suds container 2. Solenoid valve 10, water distributor 11, and dispensing system 18 are controlled by controller 7 of washing machine 1, said controller also controlling the wash cycle sequence. Dispensing system 18 is operatively connected to controller 7 via signal connection 32. The dispensing system 18 of this embodiment includes a base unit 19, a container 20 for a powdered or granular detergent, and a container 21 for a liquid or viscous detergent or treating agent.

Figure 2:
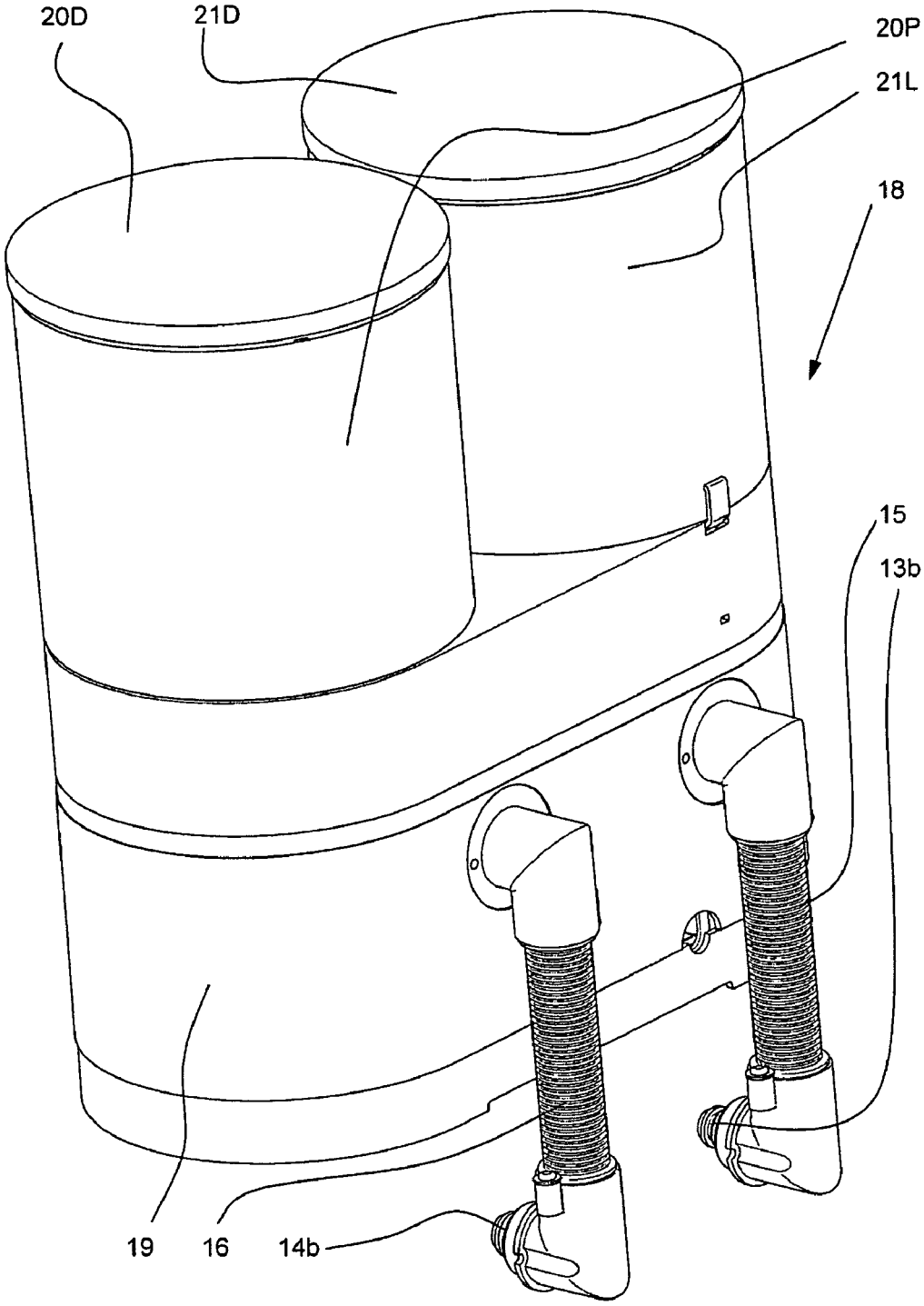
FIGS. 2 and 3 are detail views of the dispensing system.

In FIG. 2, dispensing system 18 is shown in a detail view. A container 20P for powdered treating agent and a container 21L for liquid detergent are placed on base unit 19. Connecting hoses 15, 16 extend out of base unit 19 and are provided at their free ends with coupling members 13*b*, 14*b*, which are inserted and attached to their corresponding connections 13*a*, 13*b* (FIG. 1) provided on washing machine 1. Containers 20P and 21L are each provided with a removable cover 20D, 21D to prevent the treating agents in containers 20D, 21D from being contaminated, from absorbing moisture or from drying out.

Figure 3:
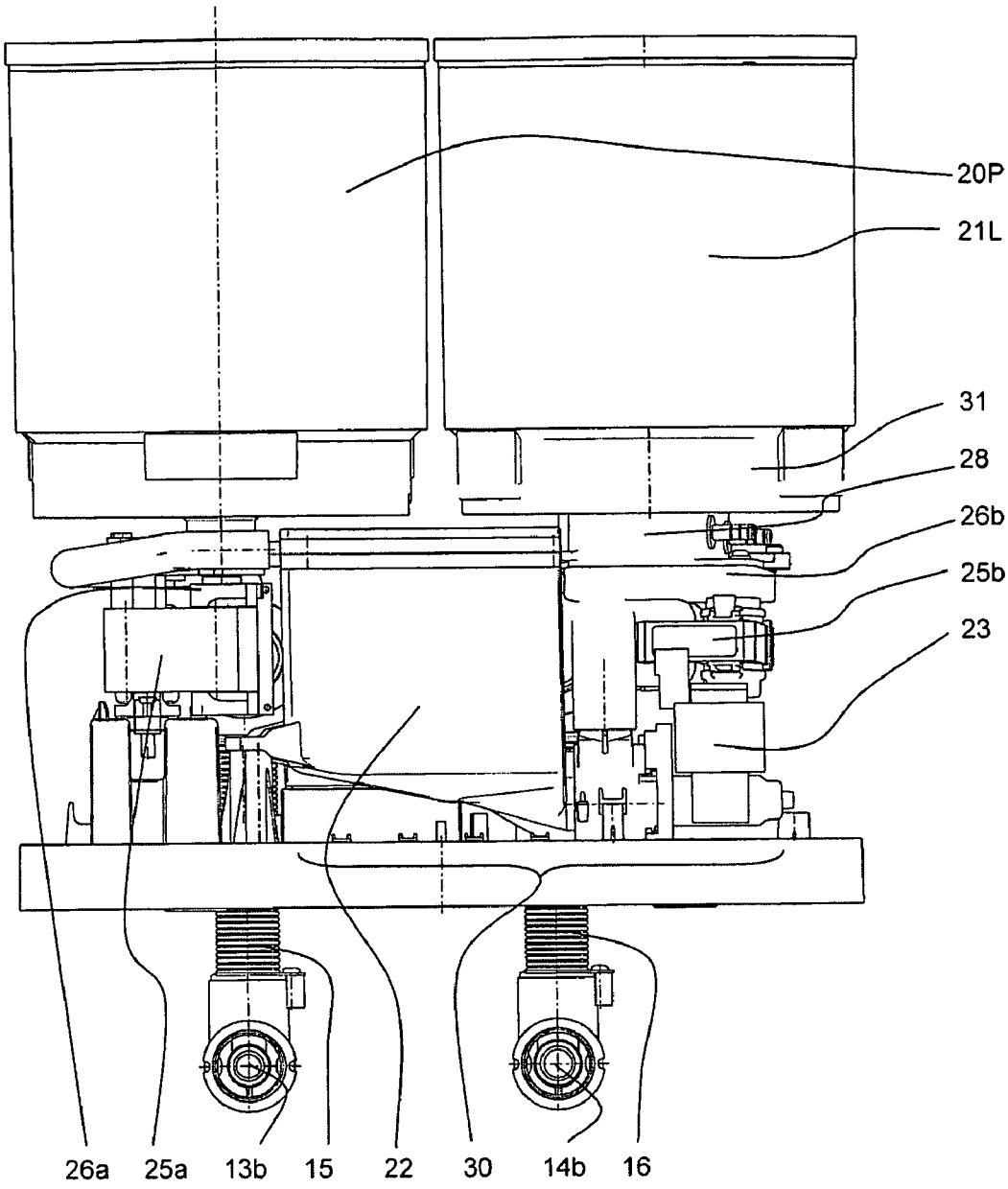
Figure 4:
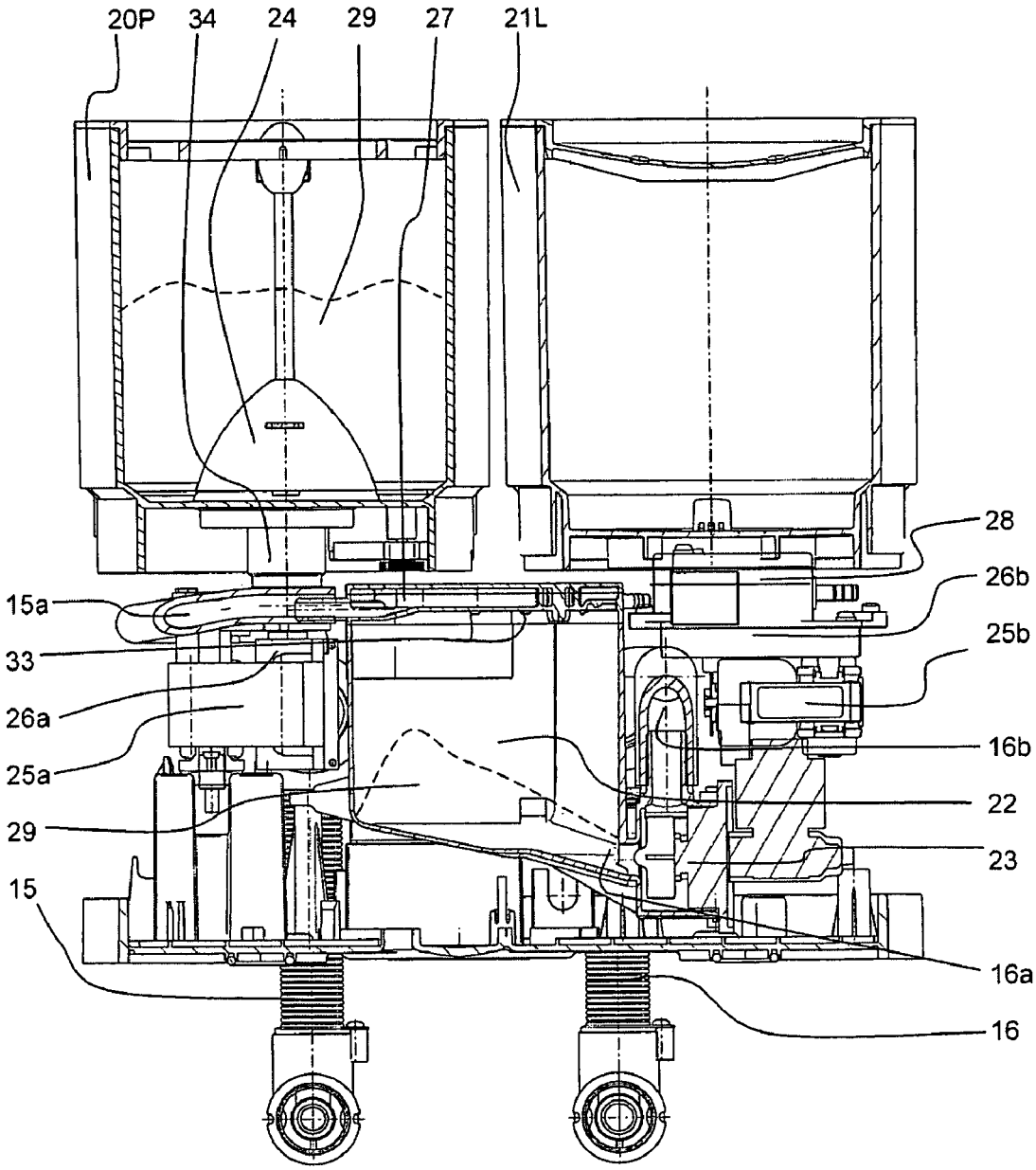
FIG. 4 shows a cross-sectional view of the dispensing system.

The side view of FIG. 3 shows, in detail, the components located in base unit 19. Mounted below first container 20P is an electric motor 25*a* which has a gear mechanism 26*a* coupled thereto and which is used to drive agitator 24 (FIG. 4). Delivery device 30 includes a mixing chamber 22 and a detergent solution pump 23 by which the treating agent flushed out in mixing chamber 22 is delivered to detergent solution conduit 16 along with the flushing water. Disposed below container 21L for liquid additives is a pump 28 which may be a peristaltic pump and is used to deliver or meter a precise amount of the agent into mixing chamber 22. Pump 28 is driven by an electric motor 25*b* with a gear mechanism 26*a*, which is called a gear motor.

The cross-sectional view of FIG. 4 illustrates the interconnection of the component parts of dispensing system 18. Container 20P for powdered treating agent has disposed therein an agitator 24 having blades or arms rotating about a vertical axis. Via an opening in the bottom of container 20P, treating agent 29 is released into mixing chamber 22 through opening 27. In the process, the rotating blades cause powdered treating agent 29 to flow through opening 27. Agitator 24 is detachably connected to an electric motor 25*a*, i.e., to the output of gear mechanism 26*a*, via a coupling 34. This allows container 20P to be removed from base unit 19 along with agitator 24, while electric motor 25*a* and gear mechanism 26*a* remain in base unit 19. A water inlet 15*a* connects to nozzles 33 directed into chamber 22 from above and is used to flush out the treating agent 29 that was metered into mixing chamber 22. When water is admitted to mixing chamber 22, the water mixed with the agent 29, i.e., the (usually concentrated) detergent solution, is directed through outflow portion 16*a* to the lower portion of chamber 22 and is pumped by detergent solution pump 23 through conduit 16*b* to detergent solution conduit 16.

The drive for second container 21L is similar in design. When using a container 21L containing a liquid treating agent, a metering pump 28 is mounted in the base unit, allowing the treating agent to be pumped into mixing chamber 22 through a further opening. Pump 28 is driven by an electric motor 25*b* with a downstream gear mechanism 26*b*. Container 21L can be removed from the base unit, while gear motor 25*a*, 26*b* and pump 28 remain in the base unit.

Figure 5A:
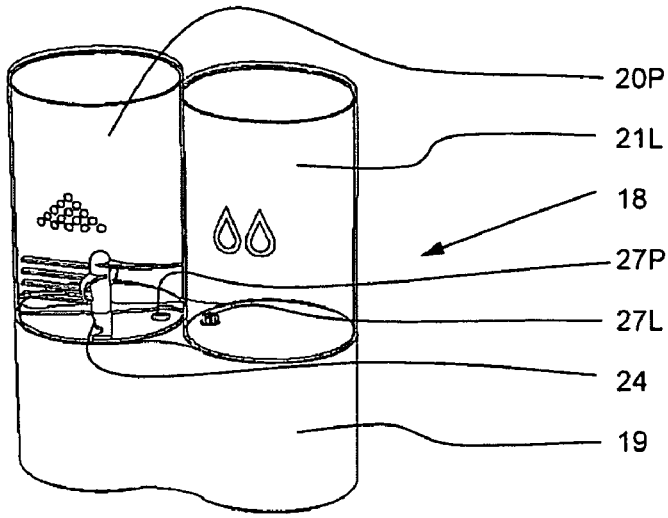
FIGS. 5*a*-5*c* are views showing possible combinations for the dispensing system.
Figure 5B:
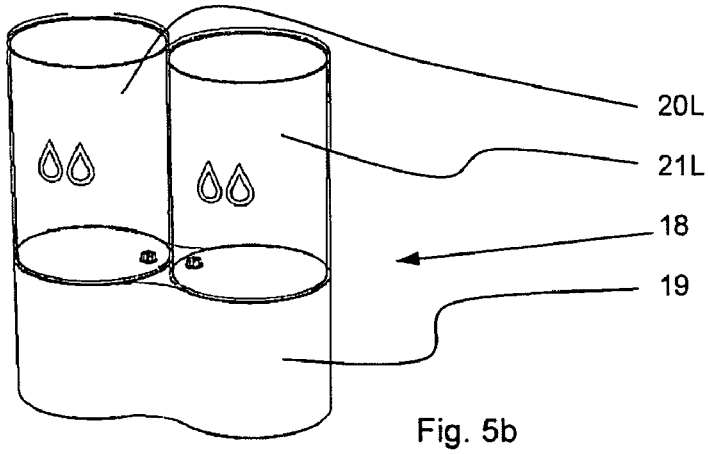
Figure 5C:
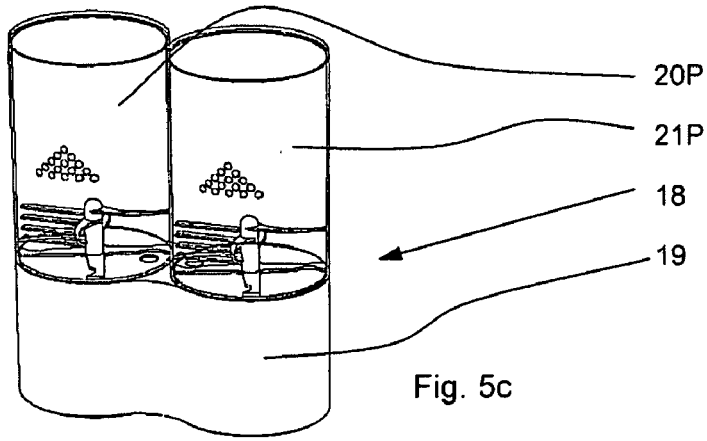

In a further embodiment, metering pump 28 is attached to the underside of container 21L and is coupled to the output of gear mechanism 26*b* via a coupling member. If the coupling members and inlet openings to mixing chamber 22 are identical in configuration, containers 20, 21 may be placed into base unit 19 as desired. FIG. 5*a* shows a combination of a container 20P for powdered treating agent and a container 20L liquid treating agent. Agitator 24 with its rotating blades 24*a* can be seen in container 20P. Opening 27P and opening 27L in the bottoms of containers 20P, 21L are directed to the central region of base unit 19, because mixing chamber 22 is located in this region below the containers (FIGS. 3, 4). FIG. 5*b* illustrates the option of equipping base unit 18 with two containers 20L, 21L for liquid treating agent. FIG. 5*c* shows that base unit 18 may be equipped with two containers 20P, 21P for powdered treating agent.

Figure 6:
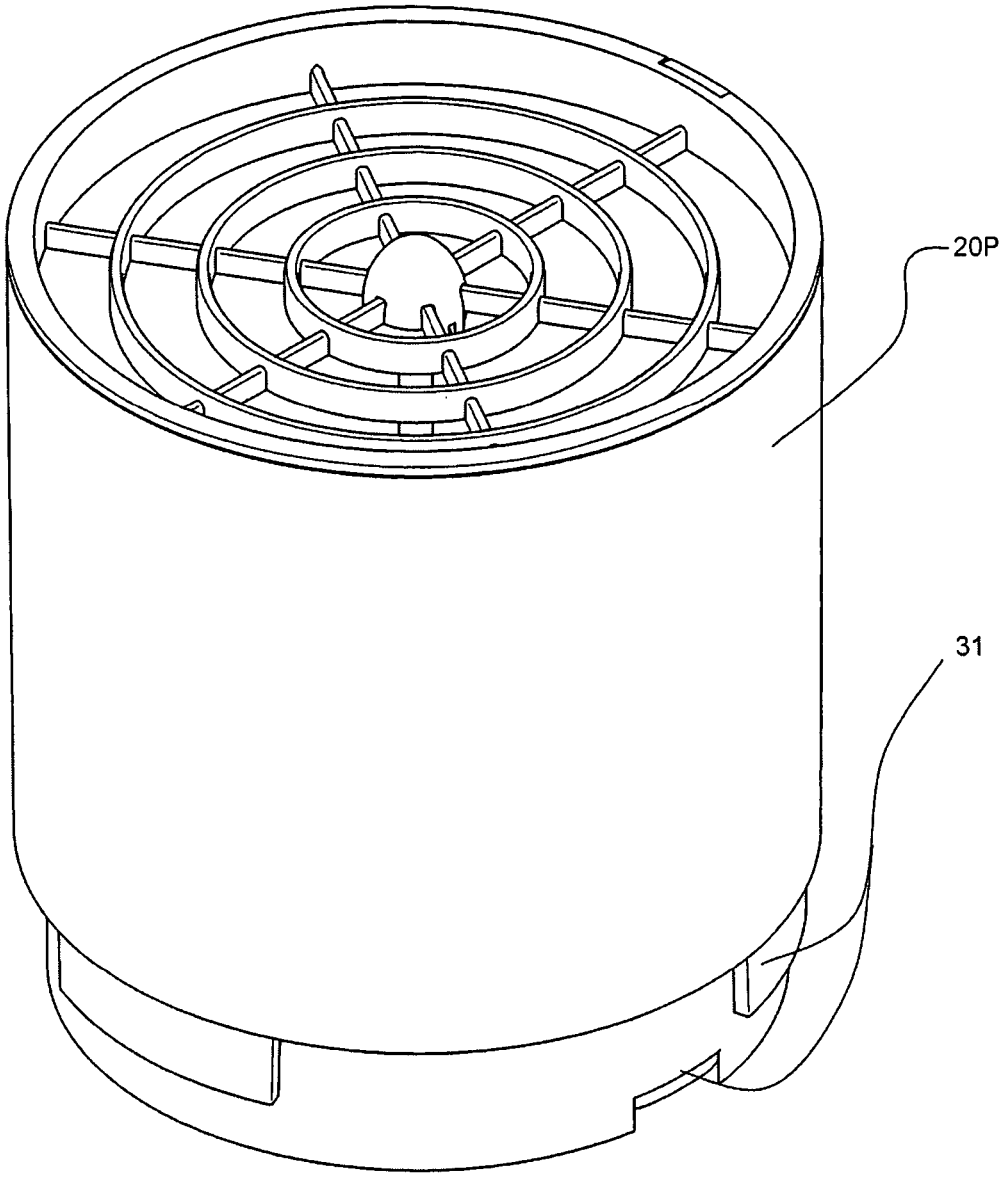
FIG. 6 is an isolated view of a container.

FIG. 6 shows container 20P in a removed condition. Projections 31 are formed on the underside, allowing attachment to base unit 19 in the manner of a bayonet (FIGS. 3, 4).

The present invention has been described herein based on one or more exemplary embodiments, but is not limited thereto. Reference should be had to the appended claims.

What is claimed is:

1. A treating agent dispensing system for a washing machine, comprising:

a base unit;

at least two supply containers removably and securably disposed on the base unit, the at least two supply containers being respectively configured to receive a treating agent, each of the supply containers being either of a powder supply container including an agitator and configured to hold a powder treating agent or a liquid supply container configured to operate with an associated pump and to hold a liquid treating agent; and a delivery device disposed in the base unit, the delivery device being operable to deliver the treating agent to the washing machine through a hose and including:

a respective electric motor corresponding to each of the at least two supply containers;

a coupling member associated with each electric motor, each coupling member being coupleable to the respective agitator when the powder supply container is disposed on the base unit and being coupleable to the respective pump when the liquid supply container is disposed on the base unit;

a mixing chamber configured to receive the treating agent from at least one of the at least two supply containers; and a detergent solution pump configured to deliver the treating agent and water that flushes out the mixing chamber to the washing machine.

2. The dispensing system as recited in claim 1, wherein the treating agent includes at least one of a detergent, a washing additive and a rinse additive.

3. The dispensing system as recited in claim 1, wherein at least one of the at least two supply containers is the powder supply container, and the treating agent is the powdered treating agent, the agitator of the powder supply container being drivable by the respective electric motor, and the powder supply container including an opening through which the powdered treating agent is admitted to the mixing chamber.

4. The dispensing system as recited in claim 3, wherein at least one of the at least two supply containers is the liquid supply container, the treating agent is the liquid treating agent, and the dispensing system is configured to drive the pump using the respective electric motor so as to deliver the liquid treating agent into the mixing chamber.

5. The dispensing system as recited in claim 4, wherein the pump is disposed on the liquid supply container and removable from the base with the liquid supply container.

6. The dispensing system as recited in claim 3, wherein the electric motor driving the agitator has a gear mechanism attached thereto so as to form a gear motor.

7. The dispensing system as recited in claim 6, wherein the gear motor driving the agitator is disposed in the base unit and a gear output of the gear motor is connected to the agitator by the respective coupling member.

8. The dispensing system as recited in claim 5, wherein the electric motor driving the pump associated with the liquid supply container has a gear mechanism attached thereto so as to form a gear motor.

9. The dispensing system as recited in claim 8, wherein the gear motor driving the pump associated with the liquid supply container is disposed in the base unit and a gear output of the gear motor is connected to the pump by the respective coupling member.

10. The dispensing system as recited in claim 1 wherein the at least two supply containers include a first and a second supply container and wherein the base is configured to receive the first and second supply containers, the first and second supply containers being, respectively:

a powder supply container and a liquid supply container, a first and a second powder supply container, or a first and a second liquid supply container.

11. The dispensing system as recited in claim 1, wherein the at least two supply containers and base unit include respective portions of a bayonet connection for securing the supply containers and base unit together.

12. The dispensing system as recited in claim 1, wherein the at least two supply containers and base unit include respective portions of a thread connection for securing the supply containers and base unit together.

13. A washing machine comprising:

a suds container configured to receive wash liquid;

a controller;

a first dispensing device including a dispensing system connected to at least one portion of the washing machine by first and second hose lines and operatively connected to the controller, the dispensing system including:

a base unit;

at least two supply containers individually removably and securably disposed on the base unit, each of the supply containers being at least one of a powder supply container including an agitator and configured to hold a powder treating agent or a liquid supply container configured to operate with an associated pump and to hold a liquid treating agent; and a delivery device disposed in the base unit, the delivery device being operable to deliver the treating agent to the washing machine through a hose and including:

a respective electric motor corresponding to each of the at least two supply containers, and a coupling member associated with each electric motor, each coupling member being coupleable to the respective agitator when the powder supply container is disposed on the base unit and being coupleable to the respective pump when the liquid supply container is disposed on the base unit, a first connection connected to the dispensing system and controllable by at least one of an inlet valve and water distributor, the first connection being configured to deliver water to the dispensing system; and a second connection configured to deliver a solution of the treating agent from the dispensing system.

14. The washing machine as recited in claim 13, wherein the second connection is connected to the suds container by a flexible conduit.

15. A washing machine comprising:

a suds container configured to receive wash liquid;

a controller;

a first dispensing device including a dispensing system connected to at least one portion of the washing machine by first and second hose lines and operatively connected to the controller, the dispensing system including:

a base unit;

at least two supply containers individually removably and securably disposed on the base unit, the at least two supply containers being respectively configured to receive a treating agent, the treating agent being a powdered treating agent or a liquid treating agent; and a delivery device disposed in the base unit, the delivery device being operable to deliver the treating agent to the washing machine through a hose, a first connection connected to the dispensing system and controllable by at least one of an inlet valve and water distributor, the first connection being configured to deliver water to the dispensing system;

a second connection configured to deliver a solution of the treating agent from the dispensing system, wherein the second connection is connected to the suds container by a flexible conduit;

a second dispensing device including a detergent dispensing drawer disposed in an upper portion of the washing machine;

a water feed line in communication with the dispensing drawer and configured to flush at least one of detergents and additives from the dispensing drawer; and a flexible connecting tube connecting an outlet of the detergent dispensing drawer to the suds container, wherein the flexible conduit opens into the flexible connecting tube.

16. The washing machine as recited in claim 13 further comprising a housing with a rear wall including a third connection configured to supply water to the at least one of an inlet valve and water distributor, and wherein the first and second connections are disposed at the rear wall.

17. The washing machine as recited in claim 14 further comprising a housing with a rear wall including a third connection configured to supply water to the at least one of an inlet valve and water distributor, and wherein the first and second connections are disposed at the rear wall.

18. The washing machine as recited in claim 15 further comprising a housing with a rear wall including a third connection configured to supply water to the at least one of an inlet valve and water distributor, and wherein the first and second connections are disposed at the rear wall.

19. The washing machine as recited in claim 13 wherein the dispensing system is disposed remotely from the at least one other portion of the washing machine.

20. The washing machine as recited in claim 13 wherein at least one of the at least two supply containers is a powder supply container, and the treating agent is the powdered treating agent, the powder supply container including an agitator drivable by an electric motor and an opening through which the powdered treating agent is admitted to a mixing chamber.

* * * * *